United States Patent [19]

Thedford, deceased

[11] Patent Number: 4,612,063

[45] Date of Patent: Sep. 16, 1986

[54] METHOD OF MAKING A FENCE STRETCHER BAR

[75] Inventor: Russell E. Thedford, deceased, late of Norman, Okla., by Russell E. Thedford, executor

[73] Assignee: Acme Fence and Iron Company, Inc., Norman, Okla.

[21] Appl. No.: 630,386

[22] Filed: Jul. 13, 1984

[51] Int. Cl.[4] ..... C21D 8/06

[52] U.S. Cl. ..... 148/12 B; 72/40; 72/47; 256/32; 256/37; 256/47; 420/523; 427/423; 427/433; 428/659

[58] Field of Search ..... 148/12 B, 31.5, 595; 428/659; 420/523; 72/39, 40, 47; 427/423, 433; 256/32, 37, 47

[56] References Cited

U.S. PATENT DOCUMENTS

| | | | |
|---|---|---|---|
| 1,552,040 | 9/1925 | Fowle et al. | 428/659 |
| 2,034,348 | 3/1936 | Lytle | 427/224 |
| 2,036,615 | 4/1936 | Wean | 428/612 |
| 2,111,826 | 3/1938 | Waltman et al. | 427/377 |
| 2,457,420 | 12/1948 | Veeder | 72/39 |
| 2,511,274 | 6/1950 | Kramer | 72/47 |
| 3,226,817 | 1/1966 | Simborg | 427/433 |
| 3,322,558 | 5/1967 | Turner, Jr. | 427/224 |
| 3,561,096 | 2/1971 | Krengel et al. | 427/433 |
| 3,594,214 | 7/1971 | Helwig et al. | 427/250 |
| 3,696,503 | 10/1972 | Krengel et al. | 427/433 |
| 3,914,481 | 10/1975 | Bostroem | 427/433 |
| 3,990,887 | 11/1976 | Hisada | 148/12 B |
| 4,059,711 | 11/1977 | Mino et al. | 428/659 |
| 4,175,412 | 11/1979 | Bernot | 72/40 |
| 4,207,362 | 6/1980 | Porter et al. | 427/433 |
| 4,360,188 | 11/1982 | Craft et al. | 256/47 |
| 4,390,377 | 6/1983 | Hogg | 148/12 B |

FOREIGN PATENT DOCUMENTS

| | | | |
|---|---|---|---|
| 0002182 | 2/1979 | Japan | 72/47 |

*Primary Examiner*—L. Dewayne Rutledge
*Assistant Examiner*—Robert L. McDowell
*Attorney, Agent, or Firm*—Laney, Dougherty, Hessin & Beavers

[57] ABSTRACT

A fence stretcher bar manufactured from a continuously fed, hot dip galvanized bar and a method of making such a stretcher bar. In a first manufacturing phase, the bar is formed from a continuously fed round rod which is rolled into a flat bar and coiled on a mandrel. The flat bar is then continuously fed into a second phase of the operation which includes annealing, cleaning with acid, coating with zinc ammonium chloride and hot dip zinc galvanizing. The material is cut to length and the cut ends are flame-spray coated with zinc. The bar is of substantially longitudinal configuration with two cut ends substantially perpendicular to a longitudinal axis thereof and having a cross section defining two parallel planar sides and two transverse curvilinear convex surfaces.

33 Claims, 10 Drawing Figures

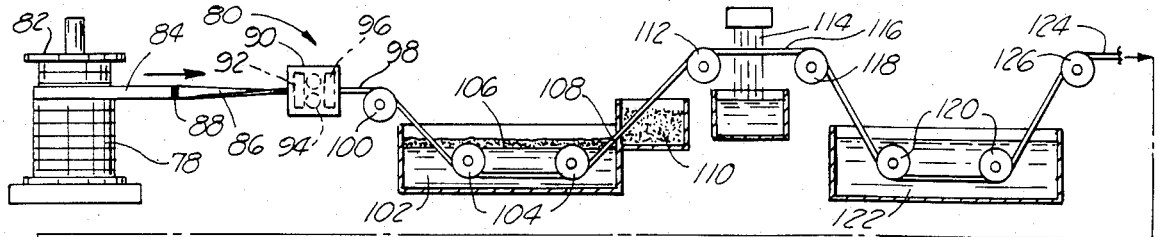
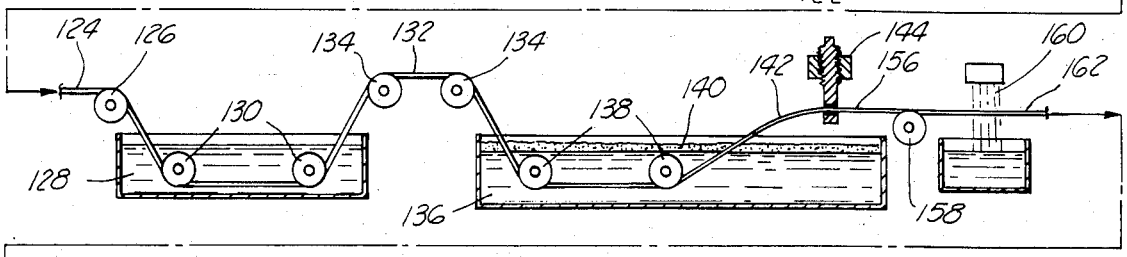
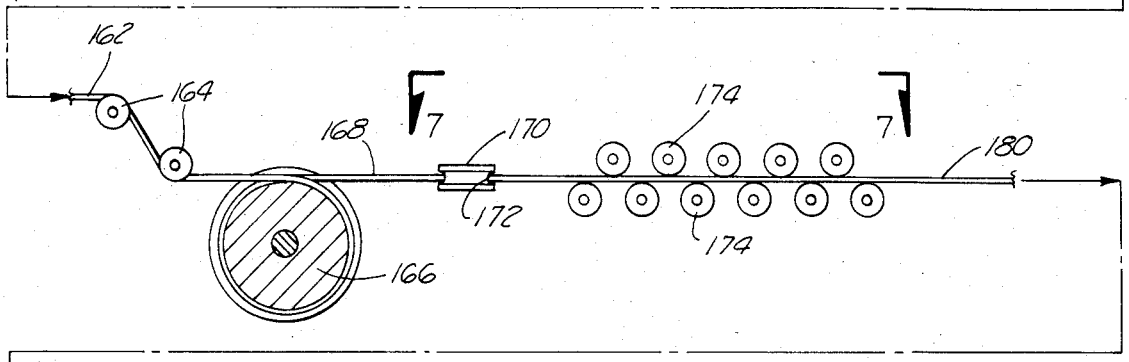
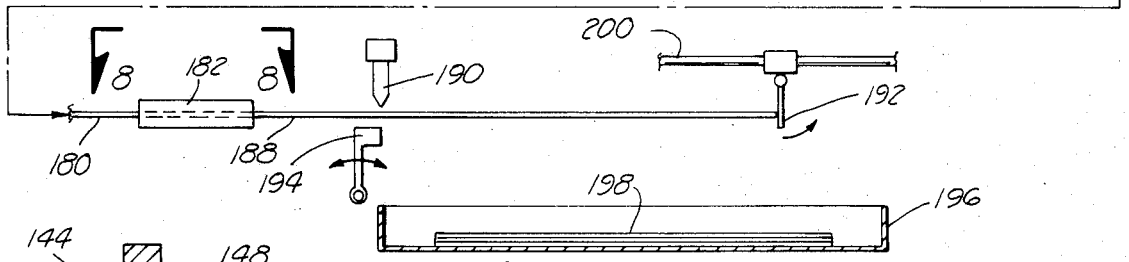
FIG. 5
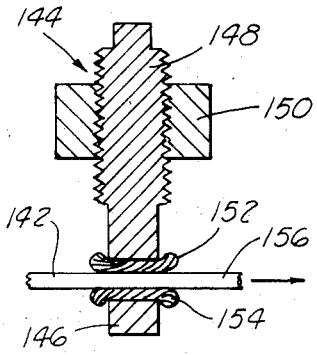
FIG. 8
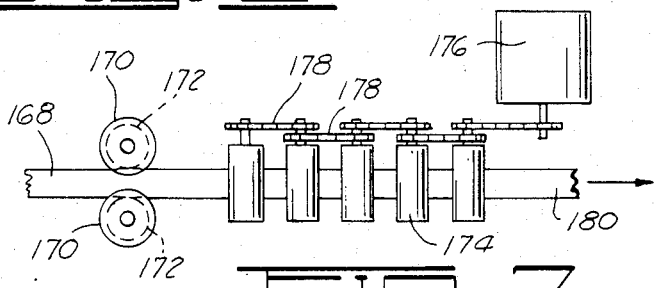
FIG. 7
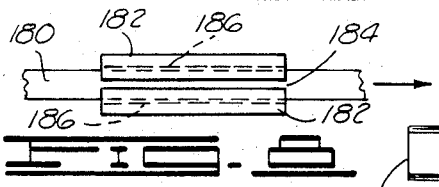
FIG. 9
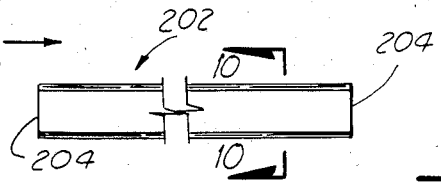
FIG. 3
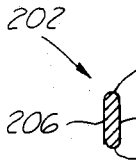
FIG. 10

METHOD OF MAKING A FENCE STRETCHER BAR

BACKGROUND OF THE INVENTION

1. Field of The Invention

This invention relates to fence stretcher bars, and more particularly, to a fence stretcher bar manufactured from a continuously fed, hot dip galvanized bar and to a method of making such a stretcher bar.

2. Brief Description of The Prior Art

Previous galvanized stretcher bars are either stamped from sheet metal or rolled in predetermined lengths prior to galvanizing. Such a method completely coats each bar, but is time consuming in that the bars must be handled as individual items during the galvanizing process. The present invention provides a method of making fence stretcher bars from a continuously fed strip of material.

There are many methods of galvanizing a continuously fed strip of material known in the art. One such method is that shown in U.S. Pat. No. 2,036,615 to Wean in which a slab of material is rolled into a coil of strip metal, cleaned and then fed into a galvanizing vat. Another process for galvanizing a continuous strip of material is shown in U.S. Pat. No. 3,696,503 to Krengel et al. After galvanizing, the material is cut to length and formed into the desired shape. In both Wean and Krengel et al., the process is designed to handle relatively wide, thin strips of material, and neither discloses a method of cold-rolling a continuously fed round rod and transferring this to a continuously fed galvanizing process.

U.S. Pat. No. 3,226,817 to Simborg et al. discloses a continuous method for fabricating and galvanizing tubing. At the beginning of this process, a continuously fed flat strip of material is rolled into a tube with a welding process to continuously weld the seam thereof. After the galvanizing process, the material is radially sized and axially cut off. No method is disclosed in Simborg for continuously galvanizing a relatively thick flat strip of material to be cut off to make fence stretcher bars.

None of the cited patents discloses the same galvanizing process as utilized in the present invention. The annealing and galvanizing steps used to treat the continuously fed bar in the present invention have been used previously for treating continuously fed, relatively small diameter round wire such as is used in making chain-link fencing. However, prior to the present invention, no method was known to use this annealing and galvanizing process for a relatively thick, continuously fed flat bar.

SUMMARY OF THE INVENTION

The fence stretcher bar of the present invention is of generally longitudinal configuration having a pair of cut ends substantially perpendicular to the longitudinal axis thereof, and having a cross section defining two parallel planar sides and a pair of transverse convex curvilinear sides. The planar and transverse curvilinear sides are hot dip zinc galvanized, and the cut ends are flame-spray coated with zinc.

In a first phase of the manufacturing process for the stretcher bar, a round steel rod is continuously fed into a descaler. After exiting the descaler, the round rod is formed into the substantially flat bar hereinbefore described. The forming process comprises a first straightening operation, a first rolling operation to cold-roll the round bar into an oversized flat bar, an intermediate straightening operation, a second rolling operation to cold-roll the oversized flat bar into a sized flat bar and a final straightening operation. The flat bar is coiled onto a powered mandrel and uniformly distributed axially thereon to end the first manufacturing phase. A tension loop in the flat bar compensates for variations in tension in the strip of material between the forming process and coiling onto the mandrel.

Beginning a second manufacturing phase, the coiled material is transferred to a non-powered payoff mandrel from which the bar is continuously fed through the remaining steps of the operation. The flat bar is annealed in a molten lead bath, water-cooled, cleaned in a hydrochloric acid bath, coated with zinc ammonium chloride and then hot dip galvanized in a zinc galvanizing kettle. Excess zinc is wiped off the galvanized flat bar and the bar is again water-cooled.

After the galvanizing and cooling procedures, the flat bar wraps around a drive drum and agin goes through a straightening process. The flat bar is frictionally held on the drive drum, and the drum is powered by a variable speed motor to pull the flat bar through the various steps of the second phase. The straightened bar is cut to a predetermined length, and the cut ends are then flame-spray coated with zinc.

An important object of the invention is to provide a method of making an galvanizing fence stretcher bar from continuously fed material.

Another object of the invention is to provide a method of forming a substantially flat bar from continuously fed round rod, galvanizing said flat bar and then cutting it into members of predetermined length.

A further object of the invention is to provide a method of cold-rolling round rod into a flat bar and annealing a continuously fed strip of the flat bar to relieve stress concentrations formed during rolling.

Still another object of the invention is to provide a fence stretcher bar of generally longitudinal configuration having two parallel planar surfaces and two transverse convex curvilinear surfaces hot dip zinc galvanized, and having two cut ends, flame-spray coated with zinc, which are substantially perpendicular to the longitudinal axis of the bar.

Additional objects and advantages of the invention will become apparent as the following detailed description of the preferred embodiment is read in conjunction with the accompanying drawings which illustrate such preferred embodiments.

BRIEF DESCRIPTION OF THE DRAWINGS

FIG. 5 shows a schematic side view of the annealing, galvanizing, and cutting phase of the method of the present invention.

FIG. 6 is a detail of a wiping means used to wipe excess zinc from the galvanized bar.

FIG. 7 is a plan view of the final straightening wheels and rollers as viewed from lines 7—7 in FIG. 5.

FIG. 8 is a plan view of a guide utilized just before the cutting operation and is seen from lines 8—8 in FIG. 5.

FIG. 9 is an elevation view of the fence stretcher bar of the present invention.

FIG. 10 is a cross section taken along lines 10—10 in FIG. 9.

DETAILED DESCRIPTION OF THE PREFERRED EMBODIMENT

Figure 1:
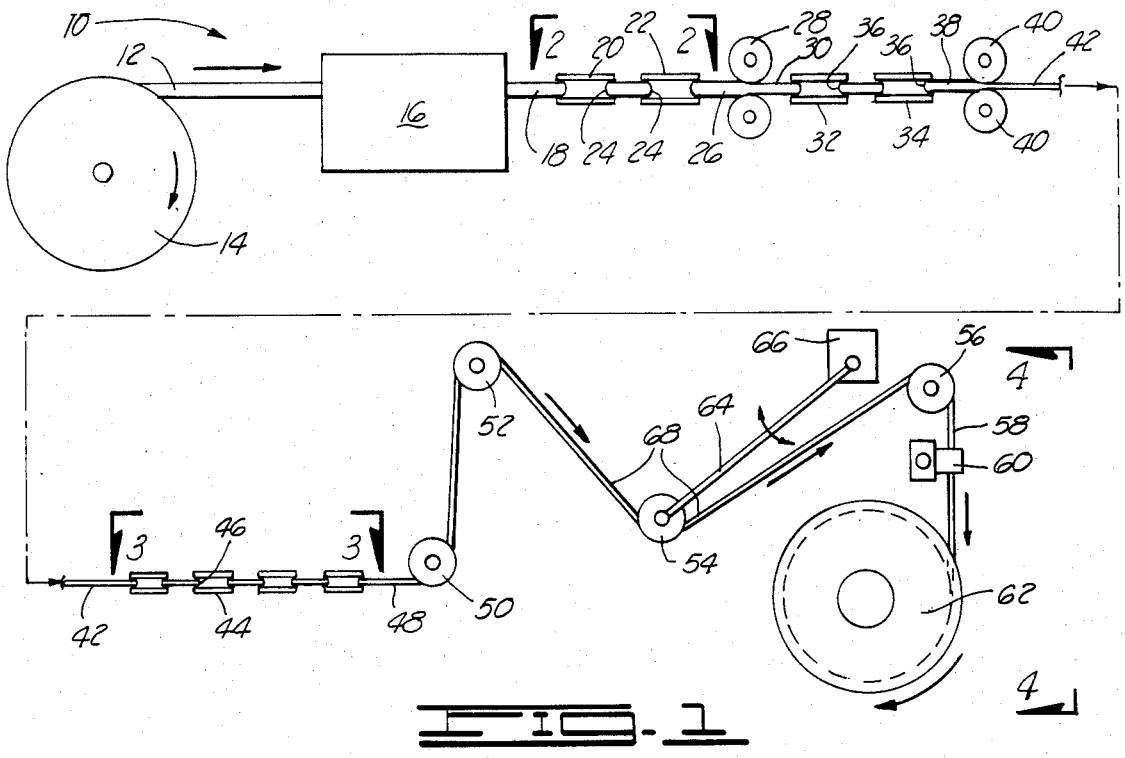
FIG. 1 shows a schematic of a side view of the cleaning, rolling and straightening phase of the method of the present invention.

Referring now to the drawings, and particularly to FIG. 1, a first phase of the method of making fence stretcher bar of the present inventon is schematically shown and generally designated by the numeral 10. In this first phase, a round steel rod 12, initially coiled on a drum 14, is continuously fed in a generally longitudinal configuration from the drum into a descaling means 16 of a kind known in the art which cleans the outer surface of the rod. In the preferred embodiment, the descaling means is a Flexiblast Model No. VB which alternately bends rod 12 in different, opposing directions, breaking surface scale therefrom, and then utilizes the removed scale as an abrasive to surface blast the rod. Any other suitable descaling apparatus could also be used.

Figure 2:
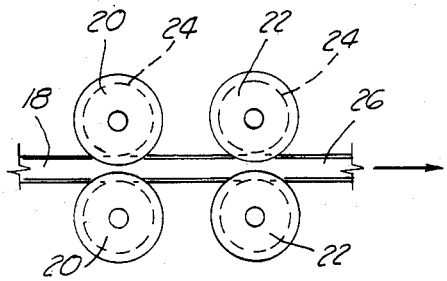
FIG. 2 is a plan view of straightening wheels for a preliminary straightening operation as viewed from lines 2—2 in FIG. 1.

The descaled rod 18, exiting from descaling means 16, passes between a first pair of horizontally disposed straightening wheels 20 and then a second pair of horizontally disposed straightening wheels 22. Referring now to FIG. 2, a plan view of wheels 20 and 22 is shown. Each wheel 20 and 22 has a circumferential groove 24 which is dimensionally corresponds to the outside diameter of round rod 18.

Straightened rod 26 then passes between a pair of rollers 28 which cold-roll the round rod to form an oversized flat bar 30 which is then fed into a pair of straightening wheels 32 and another pair of straightening wheels 34 which are similar to wheels 20 and 22. Each of wheels 32 and 34 has a circumferential groove 36 which dimensionally corresponds to oversized flat bar 30.

Figure 3:
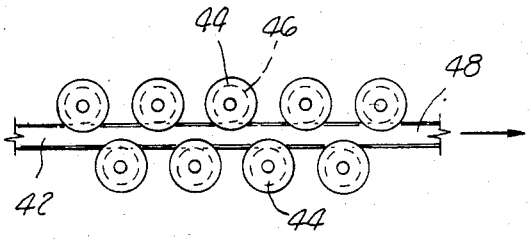
FIG. 3 is a plan view of the final straightening operation prior to take-up, as seen from lines 3—3 in FIG. 1.

Straightened, oversized bar 38 then passes between a second pair of rollers 40 which cold-roll the material into a flat bar 42 of a desired, predetermined size. Sized flat bar 42 then passes between a plurality of horizontally disposed straightening wheels 44. In the preferred embodiment, shown in FIG. 3, nine, relatively small wheels are used, but the invention is not limited to such a configuration. Each wheel 44 has a circumferential groove 46 which dimensionally corresponds to sized flat bar 42.

Straightened, sized flat bar 48 passes under a first guide pulley 50 over an elevated second guide pulley 52, under a pivotally mounted, third guide pulley 54 positioned lower than second guide pulley 52 and over an elevated, fourth guide pulley 56 as shown in FIG. 1. The flat bar then moves substantially vertically, as indicated by numeral 58, between a pair of horizontally disposed guide rollers 60 and coiled onto a powered take-up mandrel 62. Guide pulley 54 is mounted to a guide pulley arm 64 pivotally connected to a fixed pivot block 66. Guide pulley arm 64 is weighted to continuously downwardly deflect the moving strip of flat bar. There is inevitably a variation in the tension along the strip of flat bar caused by variations in the speed of mandrel 62 and the friction applied to the material through the descaling, straightening and rolling operations which results in movement of tension loop 48. Pivotally mounted guide pulley 54 moves in response to said movement of tension loop 68, thus compensating for such variations to keep the material in tension at all times.

Figure 4:
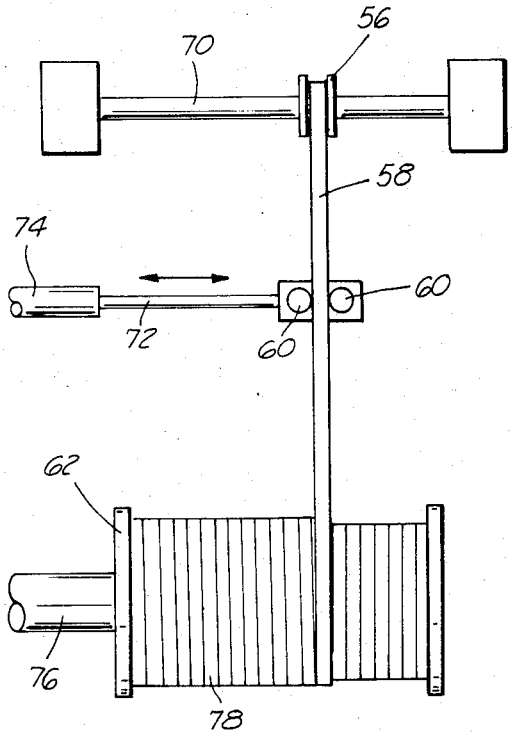
FIG. 4 is an end elevation view of a take-up mandrel utilized in the present invention, as seen from lines 4—4 in FIG. 1.

Referring now to FIG. 4, guide pulley 56 is slidably mounted on a fixed shaft 70. Guide rollers 60 are mounted to piston 72 of a horizontally disposed, reciprocating hydraulic cylinder 74. As powered, take-up mandrel 62 rotates about its axial shaft 76, piston 72, and rollers 60 attached thereto, horizontally reciprocate so that flat bar 58 is continuously, evenly distributed axially along mandrel 62 to form a coil 78 of flat bar material. During this reciprocating motion, guide pulley 56 is correspondingly moved horizontally along shaft 70 such that flat bar 58 is maintained in a substantially vertical position.

Referring now to FIG. 5, a second phase of the method of making a galvanized stretcher bar of the present invention is shown and generally designated by the numeral 80. At the beginning of this phase, flat bar coil 78 is removed from powered take-up mandrel 62 and placed on a vertically oriented, nonpowered, payoff mandrel 82. Payoff mandrel 82 is free to rotate as flat bar material 84 is pulled away from it. Flat bar 84 is attached to the end section 86 of a strip of flat bar material, previously fed into the system, by a weld 88 or the like. Thus, a continuous strip of flat bar is fed through the second phase of the operation. the strip of flat bar is rotated substantially 90° as it enters a guiding means 90. Guiding means 90 comprises a first pair of vertically disposed guide rollers 92, a pair of horizontally disposed guide rollers 94 and a second pair of vertically disposed guide rollers 96. For the simplicity of illustration, only one such guiding means 90 has been shown. However, a plurality of such guiding means may be used as necessary at various locations along the path of the flat bar strip to support and guide it as it proceeds through the second phase.

Guided flat bar strip 98 passes over a guide 100 and is guided down into, and through, a molten lead bath 102 by a pair of guides 104. In FIG. 5, guides 100 and 104, and subsequent guides described herein, are shown for schematic simplicity as pulleys or rollers. It should be noted, however, that any other suitable method of guiding may be used to direct and guide the flat bar strip through the various stages of the second phase.

Molten lead bath 102 is preferably maintained at a temperature level having a range of approximately 1100° to 1200° Fahrenheit and an upper surface thereof is covered by an insulating layer of anthracite coal 106. The coal actually burns until it is substantially turned into a layer of ash which helps retain the heat in molten lead bath 102. Molten lead bath 102 acts to burn off all foreign matter from the surface of the flat bar strip and also heats the bar sufficiently to anneal the material, thus relieving stress concentrations caused by the cleaning, straightening and rolling processes in the first phase. As annealed flat bar 108 exits the molten lead bath, it passes through a layer of sand 110 in a sand bed which wipes off lead from the surface of the bar. After passing over another guide 112, the flat bar strip is cooled by a water shower 114 which substantially cools the bar to ambient temperature.

Cooled flat bar 116 passes over guide 118 and under guides 120 which direct it into a cleaning bath of hydrochloric acid 122. Acid-cleaned flat bar 124 then moves to a galvanizing stage of the second phase by passing over guides 126 and down into a zinc ammonium chloride bath 128 guided by guides 130. The zinc ammonium chloride coats the outer surface of the acid-cleaned flat bar to act as a preflux for the zinc galvanizing step which follows. Coated flat bar 132 passes over guides 134 and is directed down into a galvanizing kettle 136 containing a hot zinc bath by guides 138. In the galvanizing kettle 136, the outer surface of the flat bar strip is covered with a hot dip galvanizing layer of said zinc. In the preferred embodiment, but not by way of limitation, the zinc used is generally referred to as high-grade zinc and has, in addition to pure zinc, an iron content of approximately 0.0006 to 0.0009 percent by weight, a lead content of approximately 0.006 to 0.009 percent by weight and a cadmium content of approximately 0.0003 to 0.0004 percent by weight and is maintained at an approximate average temperature of 860 degrees Fahreneit. Other types of zinc suitable for galvanizing may also be used. Covering an upper surface of the hot zinc is an insulating layer 140 which is preferably vermiculite. Such vermiculite is available under the name Zonolite from W. R. Grace & Company.

As galvanized flat bar 142 comes out of hot zinc kettle 136, the flat bar passes through a wiping means 144, a detail of which is shown in FIG. 6. A fixed lower wiper plate 146 is located beneath the flat bar. An adjustable screw 148 is threadingly engaged into a fixed block 150. An upper, replaceable wiper layer 152 and a lower, replaceable wiper layer 154 are formed of a soft, heat-resistant material such as fiberglass braided rope. Such a fiberglass rope material is available under the name Nor-Fab. By tightening or loosening screw 148, the wiping pressure of upper wiper layer 152 and lower wiper layer 154 can be increased or decreased, respectively, as desired. The wiping action removes excess zinc from the outer surface of galvanized flat bar 156, and further acts to smooth said outer surface.

Referring again to FIG. 5, another guide 158 directs the flat bar strip toward a water-cooling shower 160 which cools the bar to approximately ambient temperature.

Cooled, galvanized flat bar 162 is guided as necessary, such as by pulleys 164, toward a drive drum 166 and is rotated by a variable speed motor (not shown). The flat bar makes one complete loop around drive drum 166 and is frictionally held thereon such that the rotating drive drum pulls the flat bar strip, thus causing it to move along its path through the second phase of the manufacturing process shown in FIG. 5.

Following drive drum 166, flat bar strip 168 is moved to a pair of horizontally disposed straightening wheels 170. Straightening wheels 170 have a circumferential groove 172 dimensioned to conform to flat bar strip 168. Following straightening wheels 170 are a plurality of horizontally disposed, powered, straightening rollers 174. In the preferred embodiment, there are five upper rollers and six lower rollers, but the invention is not limited to such a number. Referring to FIG. 7, it can be seen that straightening rollers 174 are driven by a variable speed motor 176 which transmits power to the rollers by a plurality of interconnecting drive chains 178. Rollers 174 act to straighten the flat bar and also help propel the bar in addition to the power transmitted through drive drum 166. The variable speed motor which rotates drive drum 166 is set at a compatible speed with variable speed motor 176 driving rollers 174 so that no undesired longitudinal tension or compression is put on the flat bar and assuring that the flat bar is tightly looped around drive drum 166.

Straightened flat bar 180 next passes through a pair of longitudinally disposed guide blocks 182. Referring to FIG. 8, it can be seen that guide blocks 182 are spaced to form a gap 184 therebetween. Each guide block 182 has a longitudinal slot 186 therein which opens toward gap 184. The flat bar 180 passes through slot 186 and is guided thereby. Guided flat bar 188 is guided under a cutting blade 190, and the bar moves longitudinally away from guide blocks 182 until it strikes a limit switch 192. As the bar contacts limit switch 192, blade 190 is actuated to move downwardly to cut the bar to a predetermined length. As the bar is cut by blade 190, ejector lever 194 pivots to kick the cut bar forward so that it falls into a basket 196 where a cut bar pile 198 is formed. The length of the cut bars can be varied by moving limit switch 192 to the desired position on switch support bar 200.

Referring now to FIG. 9, a fence stretcher bar of the present invention, formed by the hereinbefore described method, is shown and generally designated by the numeral 202. Stretcher bar 202 is of generally longitudinal configuration having a pair of cut ends 204 substantially perpendicular to a longitudinal axis thereof. As shown in FIG. 10, stretcher bar 202 is generally flat and has two parallel, opposite planar sides 206 and a pair of transverse sides 208. Each of transverse sides 208 defines an outwardly convex curvilinear surface.

After the stretcher bars 202 are cut to length, they are gathered in bundles so that ends 204 are substantially aligned and adjacent one another. Cut ends 204 are then coated with zinc by a flame-spraying process. In the preferred embodiment, zinc having a purity of approximately 99.9 percent, is used.

It can be seen, therefore, that the fence stretcher bar and method of making such bar of the present invention are well adapted to carry out the ends and advantages mentioned as well as those inherent therein. Although a presently preferred embodiment of the stretcher bar and the method of making the bar are shown for the purposes of this disclosure, numerous changes in the arrangement and construction of parts may be made by those skilled in the art, which changes are included within the scope and spirit of the invention as defined by the appended claims.

What is claimed is:

1. A method of making galvanized flat bar from round rod comprising the steps of:

cleaning an outside surface of said round rod;

cold-rolling and straightening said round rod into a flat bar;

galvanizing said flat bar;

cutting said flat bar to a predetermined length to define two opposite cut ends; and zinc coating said cut ends.

2. The method of claim 1 wherein said step of cleaning said outside surface comprises:

mechanically descaling said round rod; and surface blasting said outer surface.

3. The method of claim 1 wherein said step of cold-rolling and straightening said round rod comprises:

a first straightening operation to straighten said round rod;

a first cold-rolling operation to shape said round rod into an oversized flat bar;

a second straightening operation for straightening said oversized flat bar;

a second cold-rolling operation to roll said oversized flat bar into a properly sized flat bar; and a third straightening operation for straightening said sized flat bar.

4. The method of claim 1 wherein said step of galvanizing said straightened flat bar comprises:

immersing said flat bar in an acid bath;

coating said flat bar with a zinc ammonium chloride preflux after removing said flat bar from said acid bath; and zinc galvanizing said outer surface of said flat bar.

5. The method of claim 4 wherein said acid bath comprises hydrochloric acid.

6. The method of claim 4 wherein said zinc galvanizing comprises dipping said flat bar in a hot zinc bath.

7. The method of claim 6 wherein said hot zinc bath is a high-grade zinc bath comprising:

an iron content of approximately 0.0006 to 0.0009 percent by weight;

a lead content of approximately 0.006 to 0.009 percent by weight;

a cadmium content of approximately 0.0003 to 0.0004 percent by weight; and pure zinc.

8. The method of claim 6 wherein said hot zinc bath is maintained in an approximate average temperature level of 860 degrees Fahrenheit.

9. The method of claim 6 wherein said hot zinc bath has an insulating layer of vermiculite covering an upper surface thereof.

10. The method of claim 1 wherein said step of zinc coating said cut ends comprises flame-spraying said cut ends with zinc.

11. The method of claim 1 further comprising:

heating said flat bar prior to galvanizing for annealing said flat bar and cleaning an outer surface thereof.

12. The method of claim 11 wherein said step of heating comprises immersing said flat bar in a molten lead bath.

13. The method of claim 12 wherein said molten lead bath is maintained at a temperature level having a range of approximately 1100 to 1200 degrees Fahrenheit.

14. The method of claim 12 wherein said molten lead bath has and insulating layer of anthracite coal covering an upper surface thereof.

15. A method of making galvanized flat bar comprising the steps of:

cleaning an outer surface of a continuously fed round rod;

cold-rolling and straightening said round rod into a continuously fed flat bar;

annealing said flat bar;

galvanizing said flat bar;

straightening said flat bar;

cutting said flat bar into a plurality of members of predetermined length, each of said members having two cut ends substantially perpendicular to a longitudinal axis of said member; and flame-spray coating said cut ends of said members with zinc.

16. The method of claim 15 wherein said step of cleaning said outer surface comprises:

mechanically descaling said outer surface; and shot blasting said outer surface.

17. The method of claim 15 wherein said step of cold-rolling and straightening said round rod comprises:

straightening said round rod;

rolling said round rod into an oversized flat bar;

straightening said oversized flat bar;

rolling said oversized flat bar into a sized flat bar; and straightening said sized flat bar.

18. The method of claim 15 wherein said step of annealing said flat bar comprises:

heating said flat bar in molten lead; and cooling said flat bar to ambient temperature.

19. The method of claim 18 wherein said molten lead bath is maintained at a temperature level having an approximate range of 1100 to 1200 degrees Fahrenheit.

20. The method of claim 18 wherein said molten lead bath has an insulating layer of anthracite coal covering an upper surface thereof.

21. The method of claim 15 wherein said step of galvanizing comprises:

cleaning said outer surface of said flat bar with acid;

coating said outer surface with zinc ammonium chloride;

submerging said flat bar in a hot zinc galvanizing bath;

removing excess zinc from said flat bar; and cooling said flat bar to ambient temperature.

22. The method of claim 21 wherein said hot zinc bath is a high-grade zinc bath comprising:

an iron content of approximately 0.0006 to 0.0009 percent by weight;

a lead content of approximately 0.006 to 0.009 percent by weight;

a cadmium content of approximately 0.0003 to 0.0004 percent by weight; and pure zinc.

23. The method of claim 21 wherein said hot zinc bath is maintained in an approximate average temperature level of 860 degrees Fahrenheit.

24. A method of continuously making galvanized flat bar from a continuously fed round rod comprising the steps of:

descaling said round rod;

shot-blasting round rod;

straightening said round rod;

cold-rolling said round rod into an oversized flat bar;

straightening said oversized flat bar;

cold-rolling said oversized flat bar into a sized flat bar;

straightening said sized flat bar;

forming a tension compensating loop with said sized flat bar;

coiling said flat bar onto a powered take-up mandrel;

transferring said flat bar to a non-powered payoff mandrel;

continuously feeding said flat bar from said payoff mandrel;

annealing said continuously fed flat bar;

cleaning an outer surface of said flat bar with an acid;

coating said outer surface of said flat bar with a zinc ammonium chloride preflux;

zinc galvanizing said outer surface of said flat bar;

wiping said outer surface of said flat bar for smoothing said outer surface and removing excess zinc therefrom;

cooling said flat bar to ambient temperature;

straightening said flat bar;

cutting said flat bar into a plurality of members of predetermined length having two opposite ends substantially perpendicular to a longitudinal axis thereof; and flame-spray coating said ends with zinc.

25. The method of claim 24 wherein said step of forming a tension compensating loop comprises:

passing said sized flat bar under a first pulley;

passing said sized flat bar over an elevated second pulley;

passing said sized flat bar under a weighted third pulley positioned at a lower elevation than said second pulley, said third pulley being movable in response to variations in tension in said sized flat bar;

passing said sized flat bar over an elevated fourth pulley; and continuously feeding said flat bar to said powered take-up mandrel.

26. The method of claim 24 wherein said step of coiling said flat bar onto said powered take-up mandrel comprises:

attaching said flat bar to said powered take-up mandrel;

rotating said take-up mandrel at a predetermined speed for wrapping said flat bar therearound; and horizontally and reciprocatingly guiding said flat bar in response to said speed of said take-up mandrel for evenly distributing said flat bar axially along said take-up mandrel.

27. The method of claim 24 wherein said step of annealing said flat bar comprises:

heating said flat bar fed from said non-powered payoff mandrel in a bath of molten lead;

removing lead from an outer surface of said flat bar; and water-cooling said heated flat bar to ambient temperature.

28. The method of claim 27 wherein said step of removing lead comprises passing said flat bar through a sand bed for wiping said outer surface.

29. The method of claim 27 further comprising maintaining said molten lead bath at a temperature level having a range of approximately 1100 to 1200 degrees Fahrenheit.

30. The method of claim 24 wherein said step of cleaning said flat bar with acid comprises dipping said flat bar in a bath of hydrochloric acid.

31. The method of claim 24 wherein said step of zinc galvanizing said flat bar comprises dipping said flat bar in a bath of hot zinc.

32. The method of claim 31 wherein said hot zinc bath is a high-grade zinc bath comprising:

an iron content of approximately 0.0006 to 0.0009 percent by weight;

a lead content of approximately 0.006 to 0.009 percent by weight;

a cadmium content of approximately 0.0003 to 0.0004 percent by weight; and pure zinc.

33. The method of claim 31 wherein said hot zinc bath is maintained in an approximate average temperature level of 860 degrees Fahrenheit.

* * * * *